US011408590B2

(12) United States Patent
Zhang et al.

(10) Patent No.: US 11,408,590 B2
(45) Date of Patent: Aug. 9, 2022

(54) LUMINAIRE AND ILLUMINATION SYSTEM

(71) Applicants: Traxon Technologies Ltd., Shatin (HK); OSRAM GmbH, Munich (DE)

(72) Inventors: Daoqiang Zhang, Shenzhen (CN); Ming Sang Yau, Tuen Mun (HK); RuiBin Huang, Shenzhen (CN)

(73) Assignees: TRAXON TECHNOLOGIES LTD., Shatin (HK); OSRAM GMBH, Munich (DE)

( * ) Notice: Subject to any disclaimer, the term of this patent is extended or adjusted under 35 U.S.C. 154(b) by 800 days.

(21) Appl. No.: 16/329,696

(22) PCT Filed: Aug. 24, 2017

(86) PCT No.: PCT/EP2017/071367

§ 371 (c)(1),
(2) Date: Feb. 28, 2019

(87) PCT Pub. No.: WO2018/041723

PCT Pub. Date: Mar. 8, 2018

(65) Prior Publication Data

US 2019/0195465 A1 Jun. 27, 2019

(30) Foreign Application Priority Data

Aug. 29, 2016 (CN) ..... 201610752902.X

(51) Int. Cl.
*F21V 7/09* (2006.01)
*F21Y 103/10* (2016.01)
(Continued)

(52) U.S. Cl.
CPC *F21V 7/09* (2013.01); *F21S 4/28* (2016.01); *F21S 8/036* (2013.01);
(Continued)

(58) Field of Classification Search
CPC .... F21Y 2115/10; F21Y 2113/00; F21V 7/09; F21V 7/0008; F21V 7/04; F21V 7/005; F21V 7/0025
See application file for complete search history.

(56) References Cited

U.S. PATENT DOCUMENTS 3,679,893 A * 7/1972 Shemitz ..... F21V 7/09 362/345
6,502,963 B1 * 1/2003 King ..... F21V 7/005 362/297
(Continued)

FOREIGN PATENT DOCUMENTS

CN 101023295 A 8/2007
CN 201269438 Y 7/2009
(Continued)

*Primary Examiner* — William J Carter
(74) *Attorney, Agent, or Firm* — Slater Matsil, LLP

(57) ABSTRACT

A luminaire and an illumination system are disclosed. In an embodiment a luminaire includes at least one light-emitting semiconductor chip having a main emission side and a reflector having a reflection side facing the main emission side, the reflection side being a freeform different from a circle, an ellipse, a parabola or a hyperbola when seen in cross-section, wherein a base line of the reflector runs through the main emission side and a local height of the reflection side is measured against the base line, wherein a local focal length of the reflection side is increased along the local height, concerning ray bundles coming in parallel with the base line from an exterior of the luminaire during operation, and wherein local heights do not have a common focal point.

19 Claims, 5 Drawing Sheets

(51) Int. Cl.

| | |
|---|---|
| ***F21S 8/00*** | (2006.01) |
| ***F21S 4/28*** | (2016.01) |
| *F21W 131/107* | (2006.01) |
| *F21Y 115/10* | (2016.01) |
| *F21Y 113/13* | (2016.01) |

(52) U.S. Cl.
CPC .... *F21W 2131/107* (2013.01); *F21Y 2103/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 7,513,642 | B2 | 4/2009 | Sormani | |
| 7,670,038 | B2 | 3/2010 | Schug et al. | |
| 7,794,119 | B2 | 9/2010 | Venhaus | |
| 8,545,073 | B2 | 10/2013 | Meyrenaud | |
| 8,967,841 | B2 | 3/2015 | Bohm | |
| 9,200,759 | B2 | 12/2015 | Schwarz | |
| 2005/0111220 | A1* | 5/2005 | Smith | F21V 7/0083 362/235 |
| 2008/0247170 | A1 | 10/2008 | Peck | |
| 2008/0278945 | A1* | 11/2008 | Venhaus | F21V 7/005 362/247 |
| 2010/0284181 | A1 | 11/2010 | O'Brien et al. | |
| 2017/0234508 | A1 | 8/2017 | Hesse | |

FOREIGN PATENT DOCUMENTS

| | | | |
|---|---|---|---|
| CN | 101730818 | A | 6/2010 |
| CN | 201973496 | U | 9/2011 |
| CN | 102460002 | A | 5/2012 |
| CN | 103249992 | A | 8/2013 |
| DE | 202006003306 | U1 | 5/2006 |
| DE | 202010011614 | U1 | 11/2010 |
| DE | 202011003261 | U1 | 6/2011 |
| DE | 102011017161 | A1 | 10/2012 |
| EP | 1794490 | A1 | 6/2007 |
| EP | 1794491 | A1 | 6/2007 |
| EP | 2243999 | A1 | 10/2010 |
| EP | 2492585 | A2 | 8/2012 |
| WO | 2016059148 | A1 | 4/2016 |
| WO | 2018041723 | A1 | 3/2018 |

* cited by examiner

LUMINAIRE AND ILLUMINATION SYSTEM

This patent application is a national phase filing under section 371 of PCT/EP2017/071367, filed Aug. 24, 2017, which claims the priority of Chinese patent application 201610752902.X, filed Aug. 29, 2016, each of which is incorporated herein by reference in its entirety.

TECHNICAL FIELD

The invention refers to a luminaire and an illumination system comprising such a luminaire.

SUMMARY OF THE INVENTION

Embodiments provide a luminaire which can be used to illuminate the frontage of a building without the persons in the building being dazzled or disturbed by glare.

According to at least one embodiment, the luminaire comprises one or a plurality of light-emitting semiconductor chips. The at least one light-emitting semiconductor chip has a main emission side. At the main emission side a majority of the light produced in the semiconductor chip is emitted. It is possible that all of the radiation is emitted at the main emission side. The main emission side can be formed of a semiconductor material or of a passivation layer applied to the semiconductor material. It is also possible that the main emission side is formed by a casting material around the semiconductor chips like a silicone. Furthermore, the main emission side can be formed of a luminescence conversion element that is attached to the light-emitting semiconductor chip.

According to at least one embodiment, the luminaire comprises a reflector. The reflector has a reflection side. The reflection side faces the main emission side of the light-emitting semiconductor chip. The reflector and, hence, the reflection side, is designed to form an emission pattern of the light generated in the light-emitting semiconductor chip.

According to at least one embodiment, the luminaire has a base line that runs through the main emission side. That is, the base line and the main emission side have a point of intersection. As an alternative it is possible that the base line is indeed a base plane, so that an intersection area between the main emission side and the base line is a line of intersection. Particularly, the base line and the main emission side are not parallel with each other. The base line or base plane is preferably a virtual line or plane that not necessarily has an equivalent in substance.

According to at least one embodiment, the reflection side has a couple of local heights. Each one of the local heights is measured against the base line, in particular in a direction perpendicular with the base line. In other words, the local height is the distance of a specific area of the reflection side to the base line.

According to at least one embodiment, a local focal length of the reflection side increases along the local height. That is, the greater a distance between the base line and a specific area of the reflection side, the longer the local focal length of this specific area. This is true in particular with a view to ray bundles that can be in parallel with the base line and that come from an exterior of the luminaire. In other words, the local focal length is defined for ray bundles in parallel with the base line for specific areas of the reflection side, said specific areas have different local heights against the base line.

In at least one embodiment the luminaire comprises at least one light-emitting semiconductor chip having a main emission side. Further, the luminaire comprises a reflector having a reflection side that faces the main emission side. A base line runs through the main emission side and a local height of the reflection side is measured against the base line. A local focal length of the reflection side increases along the local height, concerning ray bundles coming in parallel with the base line from an exterior of the luminaire.

In architectural lighting it is desired to accentuate and to eliminate specific parts of a building. For this purpose, comparable bright and intense light sources like light-emitting diodes, LEDs for short, are used. However, modern buildings often comprise frontages or façades that are formed to a large extent of glass. This is true for office buildings as well as for residential buildings. Due to the high brightness there is the problem that persons in the building can suffer from the glare of the architectural lighting as when conventional luminaires are used a significant part of the light can enter the glass façade and thus the building. Such glare effects can be avoided or greatly reduced by means of the reflector described herein having the reflection side with the varying local focal lengths.

According to at least one embodiment, for the local focal length fin dependence from the local height h the following is true: $f(h)/F=-0.000029(h/H)3+0.0031(h/H)2-0.0017(h/H)+0.23$. Here, H is the maximum height of the reflection side at the maximum focal length F. This formula holds true in particular with a tolerance of at most 10% or 5% or 2% or 1% of the maximum focal length F, especially for every local focal length f.

According to at least one embodiment, the reflection side has the shape of a modified parabola when seen in cross-section. In particular, the reflection side is approximately formed like one arm of the parabola. However, indeed the reflection side or the shape of the reflection side when seen in cross-section opens more rapidly than a normal parabola. For this reason, the reflection side does not have a simple geometric form but is a freeform reflection side.

According to at least one embodiment, a distance of focal points of the ray bundles towards the reflection side along the base line increases with increasing local height. In other words, when the respective focal points are projected onto the base line a distance to the reflection side in a direction parallel to the base line, in particular exactly along the base line, increases with increasing local height of the respective ray bundle. That is, with increasing local height the focal points move away from the reflection side, in a direction of the base line and in particular with reference to the light-emitting semiconductor chip.

According to at least one embodiment, the first one of the focal points is located at the point of intersection between the base line and the main emission side, when seen in cross-section. This is preferably true with a tolerance of at most 5% or 2% or 1% of the respective focal length. That is, at the base line the main emission side is in a local focal area of the reflection side.

According to at least one embodiment, focal points assigned to greater local focal lengths than the local focal length of the first one of the focal points are located on a side of the base line remote from the reflection side. In addition, these focal points that are assigned to larger local focal lengths are located out of the main emission side and not on or in the main emission side. Preferably, the longer the local focal length the greater the distance between the respective focal point and the base line.

According to at least one embodiment, the focal points are located on a bent curve when seen in cross-section. Preferably, said bent curve is a parabola or a spiral line or a hyperbola or a circle or an ellipse. Preferably, said bent curve is a parabola. It is possible that a curvature radius of said bent curve increases in a direction away from the base line. This is in particular true for focal points having greater local focal lengths than the local focal length of the first one of the focal points at a point of interception between the base line and the main emission side.

According to at least one embodiment, an angle between the base line and a direction of main emission of the luminaire is at least 1° or 2° or 5°. As an alternative or in addition, said angle is at most 20° or 15° or 10°. This is true in particular in a cross-section. That is, there is just a small angle between the base line and the direction of maximum emission. Along the direction of maximum emission, the highest luminous intensity is emitted.

According to at least one embodiment, the base line is in parallel with a mounting plane of the luminaire. The luminaire is designed to be mounted at the mounting plane. In particular, the mounting plane is on a side of the luminaire facing the building and/or wall the luminaire is attached to.

According to at least one embodiment, the light-emitting semiconductor chips are LEDs or laser diodes. In particular, all light sources of the luminaire are formed by LEDs or laser diodes. That is, all light emitted by the luminaire is generated in LEDs and/or laser diodes.

According to at least one embodiment, the luminaire comprises a plurality of the light-emitting semiconductor chips. Preferably, there is a couple of light-emitting semiconductor chips that can generate red light, a couple of semiconductor chips for generating green light and a couple of semiconductor chips for producing blue light. The semiconductor chips or group of semiconductor chips can be driven electrically independent from one another. Hence, it is possible that an emission color of the luminaire can be adjusted during operation of the luminaire.

According to at least one embodiment, the luminaire has a Lambertian emission characteristic in a plane which is parallel to the base line and also parallel with the mounting plane. Contrary to that, in a plane which is perpendicular with the mounting plane the luminaire has a relatively narrow emission characteristic so that all or virtually all of the radiation is emitted in a small angular zone or sector, for example, at least 60% or 80% or 90% or 95% of the luminous intensity. Said angular zone preferably amounts to at least 2° or 5° and/or to at most 25° or 15° or 10°.

According to at least one embodiment, the light-emitting semiconductor chips have a Lambertian emission characteristic. That is, without the reflector, the luminaire would emit the generation into a large angular zone or sector. By means of the reflector, the angular zone of emission is strongly narrowed, at least seen in a plane perpendicular with the mounting plane.

According to at least one embodiment, the reflector is made of a reflective film. Preferably, the reflector is made of a metal foil that is bent so that the reflection side is formed. For example, the reflector is made of an aluminum foil or a copper foil or an iron sheet coated with silver and/or aluminum. A thickness of the reflector amounts preferably to at least 5% or 1% or 1 per mill of a length of the reflector along the reflection side. The reflector can hence be made of a mechanical flexible material. However, in the intended use of the luminaire, the reflector preferably does not deform.

According to at least one embodiment, an angle between the base line and the main emission side is at least 30° or 35° or 40°. As an alternative or in addition, said angle is at most 70° or 60° or 50°. In particular, said angle is between 40° and 50°, for example, 45°.

According to at least one embodiment, at most 20% or 30% or 40% or 50% of the main emission side are located on a side of the base line remote from the reflection side. In other words, it is possible that the base line intersects the emission side asymmetrically. Hence, the larger part of the main emission side can be on a side of the base line that is nearer to the reflection side. Contrary, it is also possible that the base line intercepts the main emission side at a center or that a larger part of the main emission side is on a side of the base line remote from the reflection side.

According to at least one embodiment, the luminaire further comprises a housing. For example, the housing is made of plastics or of a metal like aluminum. Particularly, the housing is of a material that is robust against UV radiation as present in sunlight and is also robust against high humidity and water and dust.

According to at least one embodiment, the housing incorporates the reflector and the at least one light-emitting semiconductor chip. In particular, the housing is waterproof and/or gastight so that the reflector, as well as the semiconductor chips, are protected from environmental influences.

According to at least one embodiment, a plurality of the light-emitting semiconductor chips are located in the housing. Preferably, the semiconductor chips are arranged along a line, in particular along a straight line. The cross-sections mentioned above are in particular sectional views perpendicular with said straight line.

According to at least one embodiment, a length of the housing along the straight line exceeds a height as well as a width of the housing by at least a factor of 10 or 100 or 1000. The housing may have a rectangular, quadratic or trapezoidal cross-section.

According to at least one embodiment, the luminaire further comprises a cover sheet. The cover sheet might be a part of the housing. Light is emitted from the luminaire preferably through the cover sheet, in particular exclusively through the cover sheet. The cover sheet is, for example, made of glass or transparent plastics.

According to at least one embodiment, the cover sheet does not have an optical beam shaping function. That is, the cover sheet could be a glass plate with two parallel main faces. Otherwise, the cover sheet could be bent with a constant thickness. Hence, the cover sheet is not a lens. On the other hand, the cover sheet could comprise optical coatings like color filters or UV filters or antireflection films.

According to at least one embodiment, the cover sheet is oriented perpendicular with the base line. This is true preferably with a tolerance of at most 15° or 10° or 5° or 1°.

According to at least one embodiment, the cover sheet touches the reflector on a side remote from the at least one light-emitting semiconductor chip. That is, the reflector could be stabilized and/or mounted on the cover sheet.

According to at least one embodiment, the reflector comprises a plurality of facets. Preferably, the facets run perpendicular with the base line and/or the local heights, for example, with a tolerance of at most 15° or 5° or 1°. The facets can be separated from one another by a sharp kink or by a smooth bend. The facets can be formed as plane surfaces which are free or virtually free of a curvature. As an alternative, the facets can be curved, in particular when seen in a cross-section, so that each facet can be shaped concavely or convexly. It is also possible that there is a mixture of plane, concavely curved and/or convexly curved facets that compose the reflection side.

According to at least one embodiment, the reflection side deviates in the individual facets from an averaged, fitted mean shape of the reflector by at most 10% or 5% or 2% or 1% of the maximum height of the reflection side. For example, in cross-section the averaged shape is represented by a spline fit, preferably by a cubic spline or a so-called B-spline. Control points of the spline can be the borders between adjacent facets. That is, by the facets the basic shape of the reflection side is not significantly changed.

According to at least one embodiment, the reflection side comprises at least 5 or 8 facets. As an alternative or in addition, the reflection side is composed of at most 100 or 30 or 15 facets.

Further, an illumination system is provided. The illumination system comprises one or a plurality of luminaires as explained in connection with one or more of the above-described embodiments. Thus, features for the luminaire are also disclosed for the illumination system and vice versa.

In at least one embodiment of the illumination system, the at least one luminaire is arranged on a wall or a pillar of a building. It is possible that the building, in particular said wall or said pillar, has at least in part a glass front or glass façade.

According to at least one embodiment, the luminaire is intended to illuminate a part of the building. Said part to be illuminated preferably protrudes from the wall or pillar on which the luminaire is arranged.

According to at least one embodiment, at most 5% or 2% or 1% or 0.3% of the light emitted by the luminaire enters the building, in particular through the glass front or glass façade. Hence, glare within the building is avoided. This is achieved in particular by the shape of the reflection side.

According to at least one embodiment, the luminaire has the form of a sectional strip, in German known as Profilleiste. The luminaire and thus the sectional strip is preferably arranged on an exterior face of the wall or pillar. Said exterior face can face the part of the building to be illuminated, or an angle between said exterior face and the part of the building to be illuminated is at least 90° or 120° or 140° and/or at most 170° or 155°.

According to at least one embodiment, the main emission sides of the light-emitting semiconductor chips face away from the wall or pillar and also face away from the part of the building to be illuminated. Hence, light generated in the at least one light-emitting semiconductor chip is emitted from the luminaire preferably only after reflection on the reflection side. In particular, light is emitted from the luminaire after exactly one reflection on the reflection side.

Moreover, preferably no light coming directly from the light-emitting semiconductor chip and not reflected on the reflection side is emitted. In this case this means that no technologically significant portion of light is emitted in such a way; this could mean a fraction of light of at most 2% or 0.5% or 0.1% of the overall emitted radiation.

BRIEF DESCRIPTION OF THE DRAWINGS

A luminaire and an illumination system described herein are explained in greater detail below by way of exemplary embodiments with reference to the drawings. Elements which are the same in the individual figures are indicated with the same reference numerals. The relationships between the elements are not shown to scale, however, individual elements may be shown exaggeratedly large to assist in understanding.

In the figures.

DETAILED DESCRIPTION OF ILLUSTRATIVE EMBODIMENTS

Figure 1A:
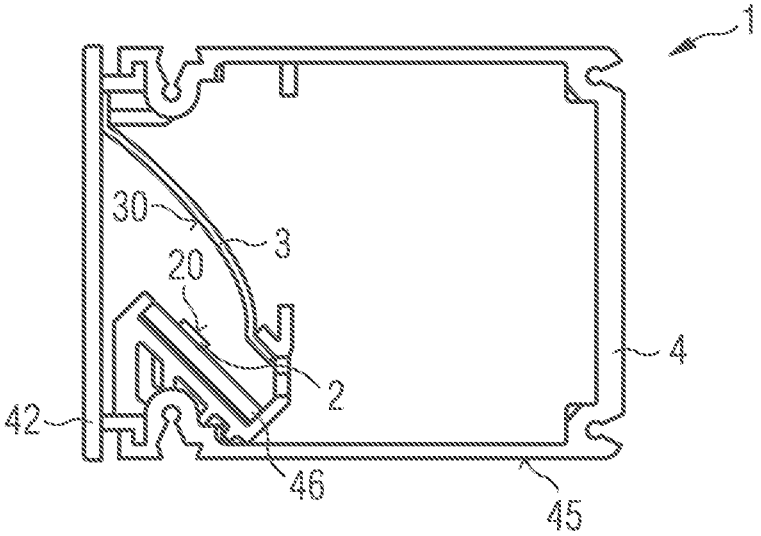
FIGS. 1A-1C and 6A-6B show exemplary embodiments of luminaires.
Figure 1B:
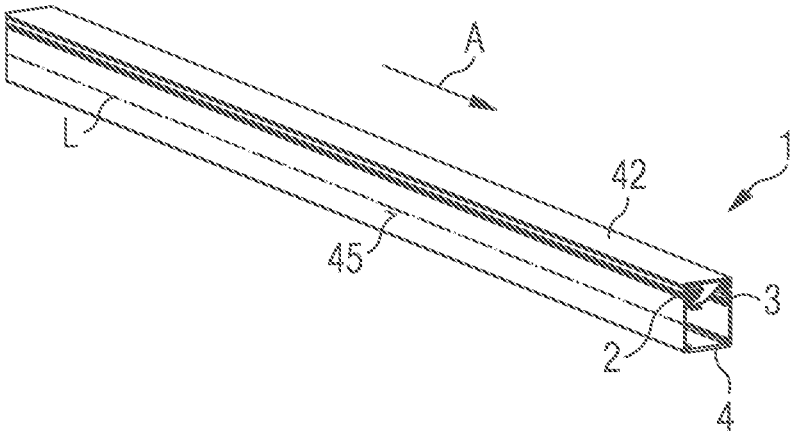
Figure 1C:
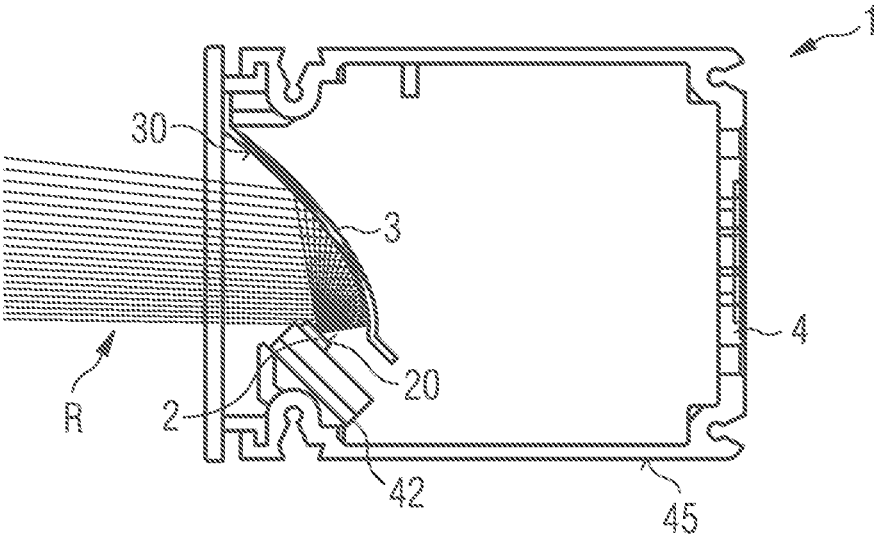

In FIGS. 1A and 1C sectional views, and in FIG. 1B a perspective view of an exemplary embodiment of a luminaire 1 are shown. The luminaire 1 comprises a plurality of light-emitting semiconductor chips 2 which are formed by LED chips. The light-emitting semiconductor chips 2 are arranged on a straight line L and can independently emit red, green and blue light or also other colored light like yellow or cyan or orange. In FIG. 1C, generated radiation R is shown schematically.

The luminaire 1 further comprises a reflector 3. A reflection side 30 of the reflector 3 faces a main emission side 20 of the semiconductor chips 2. The reflection side 30 is approximately formed like a semi-parabola, wherein said modified parabola opens more strongly than a regular parabola. By means of the reflector a light emission pattern of the luminaire 1 is formed. All or nearly all light generated by the semiconductor chips 2 is emitted after just one reflection at the reflection side 30. No, or virtually no, light from the semiconductor chips 2 emit the luminaire 1 directly.

As an option, the semiconductor chips 2 are located on a heatsink 46. The heatsink 46 as well as the semiconductor chips 2 and the reflector 3 are located in a housing 4. The housing 4 preferably is waterproof and gastight. The housing 4 comprises a cover sheet, for example, made of glass. The light generated in the semiconductor chips 2 is emitted from the luminaire 1 through the cover sheet 42.

The housing 4 also has a mounting plane 45. In particular, the luminaire 1 is designed to be arranged on an external surface via the mounting plane 45. For this purpose, the housing 4 could comprise openings and/or recesses to ensure an easy mounting of the luminaire 1.

Preferably, see FIG. 1B, the luminaire is formed as a sectional strip along a longitudinal axis A. Hence, the luminaire 1 has a length along the longitudinal axis A that is significantly larger than a width and a height of the luminaire.

Figure 2A:
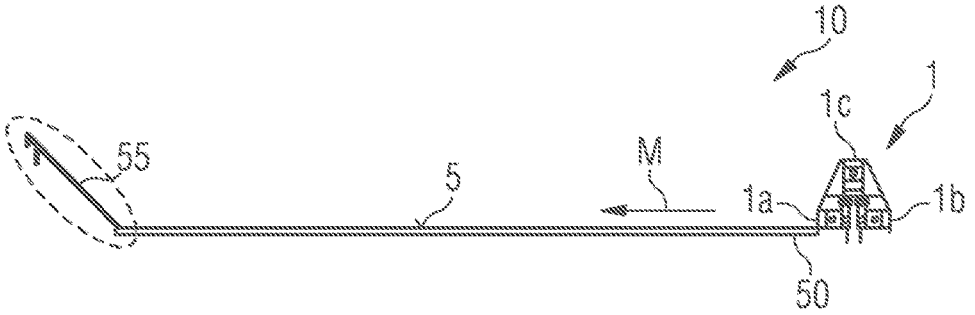
FIG. 2A-2B shows exemplary embodiments of illumination systems.
Figure 2B:
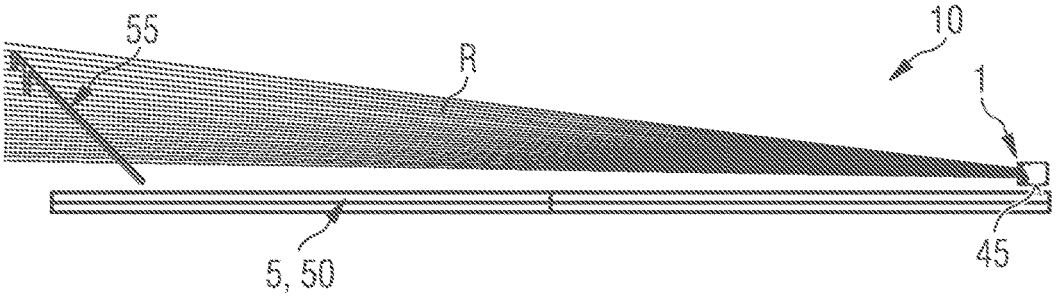

In FIGS. 2A and 2B, exemplary embodiments of an illumination system 10 comprising a luminaire 1 are shown in sectional views. In each case, the luminaire 1 is arranged on a building 50 with a wall 5. A direction M of maximum emission of the luminaire 1 is approximately parallel with the wall 5 on which the luminaire 1 is mounted. The wall 5 is purposefully not, or not significantly, illuminated by the luminaire 1.

Further, there is a protrusion that forms a part 55 of the building 50 to be laminated. A radiation R generated by the luminaire is led to said part 55. Hence, in particular due to the reflector 3 only said part 55 is illuminated and it is avoided that persons in the building 50 are glared by the luminaire 1. An angle between said part 55 and the wall 5 can exceed 90°, and is by way of example around 135° as shown in FIG. 2.

According to FIG. 2B, the luminaire 1 is in particular configured as described in connection with FIG. 1. Contrary to that, according to FIG. 2A a more complex luminaire 1 is used. The luminaire 1 of FIG. 2A comprises three subunits 1*a*, 1*b*, 1*c* that emit light in different directions. Such luminaires comprising more than one subunit can also be used in all of the other exemplary embodiments.

Figure 3:
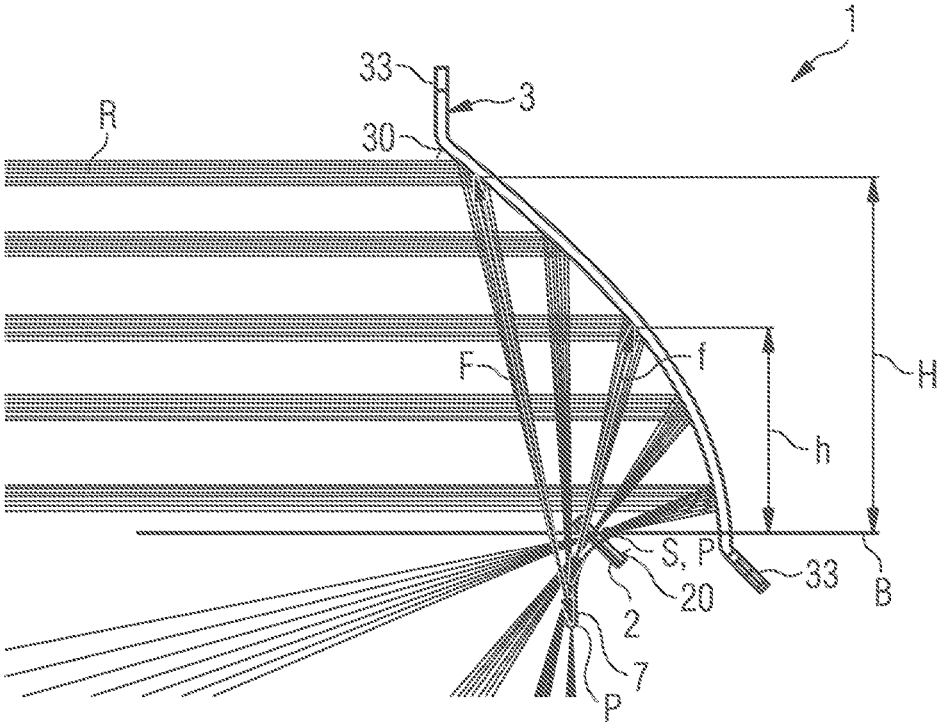
FIGS. 3 to 5 show optical properties of luminaires.

FIG. 3 shows another exemplary embodiment of the luminaire 1 in a cross-section. Here, the emphasis is on the optics.

There is a base line B that intercepts the main emission side 20 of the semiconductor chip 2. An angle between the main emission side 20 and the base line B is about 45°. From the base line B, a local height h and a maximum H of the reflection side 30 are measured. For different local heights h, the reflection side 30 shows different local focal lengths f. At the maximum height H, there is a maximum focal length F.

The different local focal lengths f are illustrated in FIG. 3 with the help of parallel ray bundles R that come from an exterior of the luminaire 1. These different parallel ray bundles R are focused by the reflection side 30 into focal points P. One of said focal points P is on or very close to a point S of intersection between the base line B and the main emission side 20.

When seen in cross-section, the focal points P are located on a bent curve 7. Said bent curve 7 begins approximately at the point S of intersection. A radius of curvature of said bent curve 7 increases towards focal points P that are associated with larger local focal lengths f. With increasing local focal length f, the associated focal point P moves away from the base line B. Further, at least some or all of the focal points P move away from the reflection side 30 when seen in projection on the base line B. That is, the larger the local focal length f, the more left-sided is the corresponding focal point P in FIG. 3.

As an option, the reflector 3 comprises one or more mounting parts 33 that protrude from the reflection side 30. In the area of the mounting parts 33, the reflector 3 which is preferably made of a metal foil, can be fixed in the housing 4, for example, near the heatsink 46 and near the cover sheet 42, compare FIG. 1A.

Figure 4:
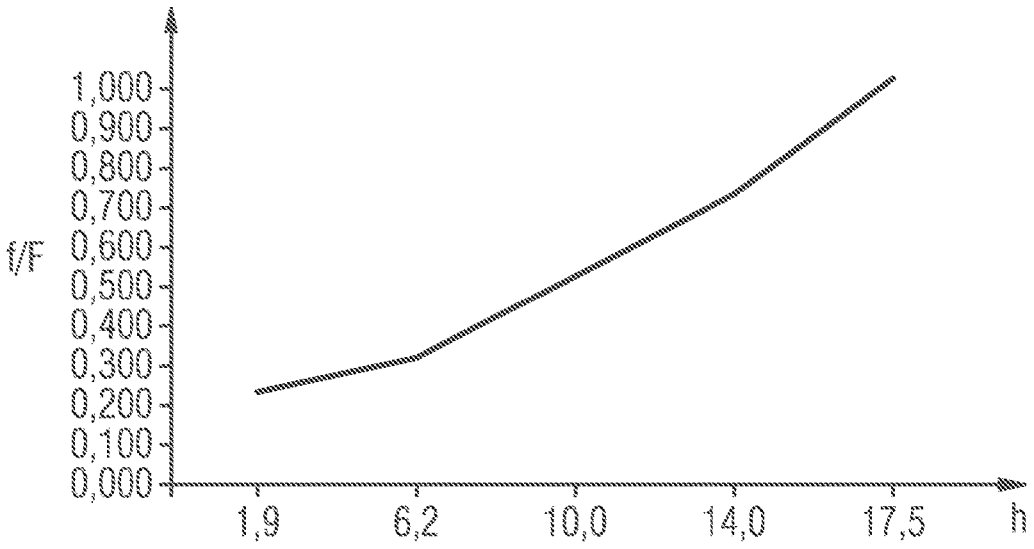

In FIG. 4, the local height h is drawn in arbitrary units against the normalized local focal length. Normalized means that the local focal length f is divided by the maximum focal length F. The normalized local focal length f/F follows a cubic equation. In the exemplary embodiment of FIGS. 3 and 4, the normalized local focal length f/F follows the following equation:

$$f(h)/F=-0.000028821233(h/H)3+0.003108357(h/H)2-0.00170994(h/H)+0.22830713.$$

Figure 5:
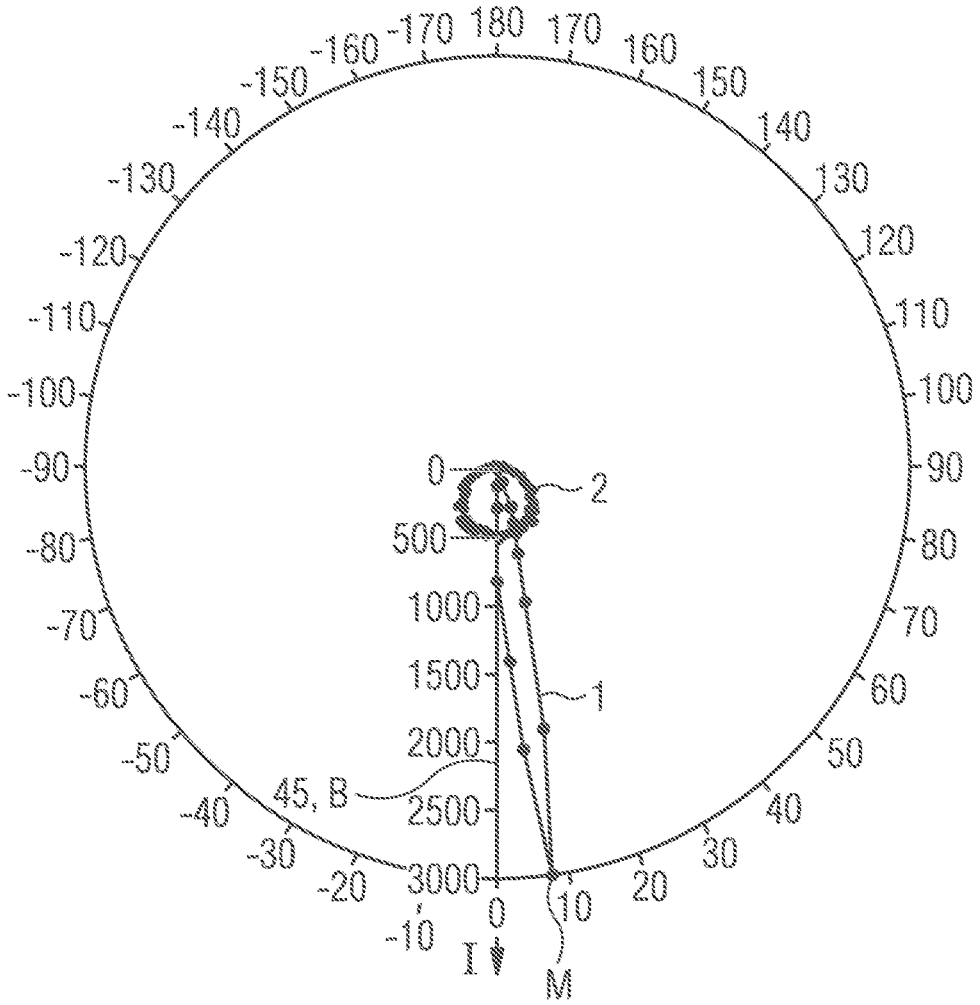

In FIG. 5, an emission characteristic of the luminaire 1 is provided. A luminous intensity I is drawn in arbitrary units against an angle of emission with respect to the mounting plane 45 and the base line B. The direction M of maximum emission is at an angle of about 8°.

For comparison, an exemplary emission pattern of the semiconductor chip 2 is also indicated. The emission pattern of the semiconductor chip 2 is approximately Lambertian. By means of the reflector 3, the luminous intensity is strongly enhanced in the direction M of maximum emission. Thus, in a plane perpendicular to the mounting plane 45 there is only an emission into a small sector.

Figure 6A:
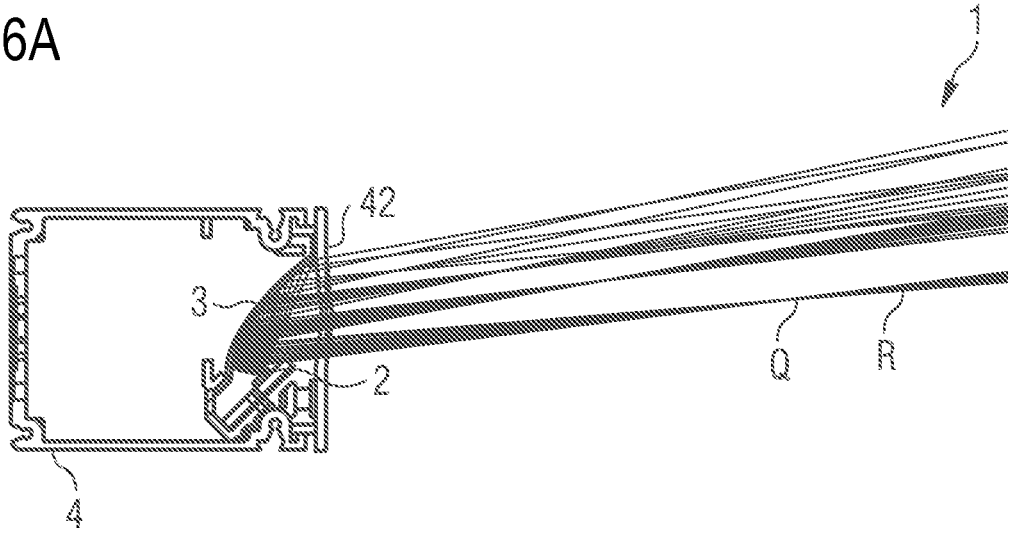
Figure 6B:
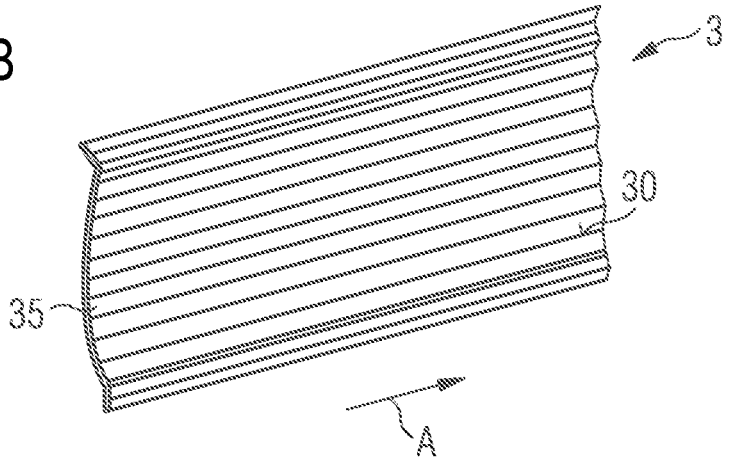

FIG. 6A shows a cross-sectional view of a further exemplary embodiment of the luminaire 1, the respective reflector 3 can be seen in more detail in FIG. 6B in a perspective view. The housing 4 can correspond to the housing of FIG. 1.

This type of reflector 3 is also based on a freeform reflector profile, but the reflection side 30 is divided into a plurality of facets 35. Borders between the facets 35 can be constituted by kinks. Preferably, the overall shape of the reflections side 30 is not strongly influenced by the partitioning into the facets 35. The individual facets 35 can be of convex shape so that a plurality of further focal points Q results in the exterior of the luminaire 1. A distance of the further focal points Q to the cover sheet 42 is, for example, between 50% and 500% of the maximum height H of the reflection side 30. However, preferably there is no common focal plane so that a distance of the further focal points Q towards the cover sheet 42 varies.

As an option, as in all the other exemplary embodiments, the cover sheet 42 can be formed as a convex lens. Further, contrary to what is shown in FIG. 6B, there can be a plurality of different facets along the longitudinal axis A so that the reflection side 30 can have kinks or bends along the longitudinal axis A, too.

This solution can resolve big color differences due to the light-emitting semiconductor chips 2 and can improve color uniformity of the resulting light spot. Otherwise, color uniformity may be impaired by the use of semiconductor chips 2 with different emission colors, for example, a mixture of red, green and blue emitting semiconductor chips 2, or may be impaired by non-uniformity of a luminescence conversion element (not shown) that is a part of the semiconductor chips 2. If the semiconductors chips 2 show good color uniformity, however, the freeform solution as presented in connection with FIG. 1 is preferred.

Figure 7A:
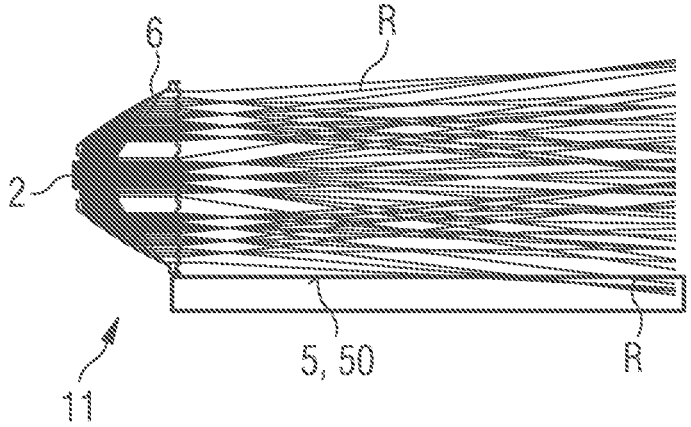
FIGS. 7A-7B and 8 show modifications of illumination systems.
Figure 7B:
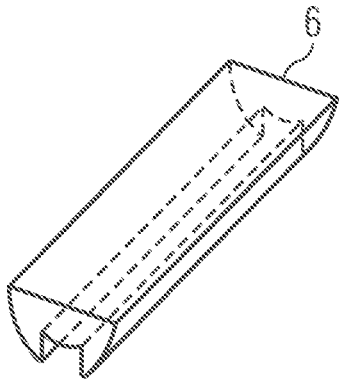

In the sectional view in FIG. 7A and in the perspective view in FIG. 7B a modification 11 of an illumination system is illustrated. A lens 6 which is a lens with total internal reflective parts follows an LED chip 2. However, the light of the LED chip 2 is not perfectly parallelized so that a divergent bundle of rays R is present. Thus, a part of the rays R enters and runs through a glass face of the wall 5 of the building 50. Thus, glaring of persons within the building 50 can occur.

Figure 8:
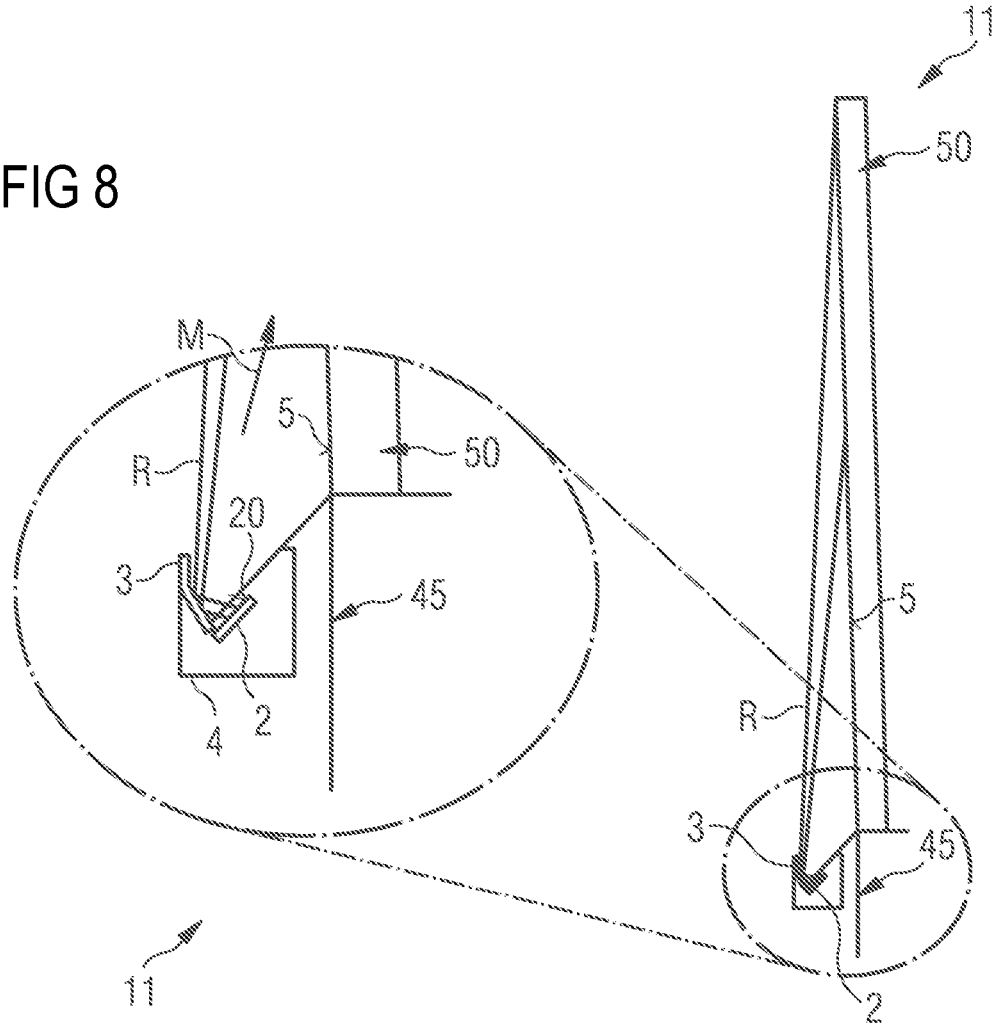

The same is true for the modification 11 of FIG. 8. Here, the main emission side 20 points to the same side as the direction M of maximum emission. Thus, the bundle of rays R points toward the wall 5. For this reason, glaring of persons in the building 50 can also occur.

These problems can be avoided or greatly reduced by the reflector 3 and the arrangement of the light-emitting semiconductor chip 2 as explained in connection with FIGS. 1 to 5. Further, the part 55 can be illuminated with good uniformity and homogeneity.

The invention described is not restricted by the description given with reference to the exemplary embodiment. Rather, the invention encompasses any novel feature and any combination of features, including in particular any combination of features in the claims, even if this feature or this combination is not itself explicitly indicated in the claims or exemplary embodiments.

The invention claimed is:

1. A luminaire comprising:

at least one light-emitting semiconductor chip having a main emission side; and a reflector having a reflection side facing the main emission side, the reflection side being a freeform different from a circle, an ellipse, a parabola or a hyperbola when seen in cross-section, wherein a base line of the luminaire runs through the main emission side and a local height of the reflection side is measured against the base line, wherein a local focal length of the reflection side is increased along the local height when ray bundles come in parallel with the base line from an exterior of the luminaire during operation, wherein local heights do not have a common focal point, wherein the following is true with a tolerance of at most 5% of a maximum focal length F for the local focal length fin dependence from the local height h:

f(h)/F=−0.000029 (h/H)3+0.0031 (h/H)2−0.0017 (h/H)+0.23, and wherein H is a maximum height of the reflection side at the maximum focal length F.

2. The luminaire according to claim 1, wherein the reflection side has a shape of a modified parabola when seen in the cross-section so that a distance of focal points of the ray bundles toward the reflection side along the base line increases with increasing local height, and wherein the reflector comprises a metal foil.

3. The luminaire according to claim 2, wherein a first one of the focal points is located at a point of intersection between the base line and the main emission side, with a tolerance of at most 5% of the respective local focal length, and wherein the focal points assigned to greater local focal lengths than the local focal length of the first one of the focal points are located on a side of the base line remote from the reflection side and are located out of the main emission side.

4. The luminaire according to claim 2, wherein the focal points are located on a bended curve when seen in the cross-section, the bended curve being a parabola or a spiral line, and wherein a curvature radius of the bended curve increases in a direction away from the base line.

5. The luminaire according to claim 1, wherein an angle between the base line and a direction of maximum emission of the luminaire is at least 2° and at most 15°, and wherein the base line is in parallel with a mounting plane of the luminaire.

6. The luminaire according to claim 5, wherein the at least one light-emitting semiconductor chip comprises LEDs configured to independently generate red, green and blue light so that an emission color of the luminaire can be adjusted during operation, and wherein the luminaire in a plane which is parallel to the base line and also to the mounting plane and/or the at least one light-emitting semiconductor chip has a Lambertian emission characteristic.

7. The luminaire according to claim 1, wherein an angle between the base line and the main emission side is at least 30° and at most 60°, and wherein at most 40% of the main emission side are on a side of the base line remote from the reflection side.

8. The luminaire according to claim 1, further comprising a housing in which the reflector and the light-emitting semiconductor chip are located, wherein the housing encloses the reflector and the light-emitting semiconductor chip in a waterproof and gas tight manner.

9. The luminaire according to claim 8, wherein the housing comprises a plurality of the light-emitting semiconductor chips arranged along a straight line, and wherein a length of the housing along the straight line exceeds a height as well as a width of the housing by at least a factor of 100.

10. The luminaire according to claim 1, further comprising a cover sheet, wherein the luminaire is configured to emit light through the cover sheet, wherein the cover sheet is oriented perpendicular to the base line and touches the reflector on a side remote from the at least one light-emitting semiconductor chip.

11. The luminaire according to claim 1, wherein the reflector comprises a plurality of facets, the facets running perpendicular to the base line and the local heights and being separated from one another by a kink in each case, and wherein the reflection side deviates in individual facets from an averaged, fitted mean shape of the reflector by at most 2% of the maximum height of the reflection side.

12. An illumination system comprising:

at least one luminaire according to claim 1, wherein the luminaire is arranged on a wall or a pillar of a building which has at least in part a glass front, wherein the luminaire is arranged to illuminate a part of the building that protrudes from the wall or the pillar, and wherein at most 2% of the light emitted by the luminaire enters the building so that glaring within the building is avoided.

13. The illumination system according to claim 12, wherein the luminaire is a sectional strip arranged on an exterior face of the wall or the pillar and facing the part of the building to be illuminated.

14. The illumination system according to claim 12, wherein the main emission side faces away from the wall or the pillar and faces away from the part of the building to be illuminated, and wherein light generated in the at least one light-emitting semiconductor chip is emitted from the luminaire after one reflection on the reflection side during operation.

15. A luminaire comprising:

at least one light-emitting semiconductor chip having a main emission side; and a reflector having a reflection side facing the main emission side, the reflection side being a freeform different from a circle, an ellipse, a parabola or a hyperbola when seen in cross-section, wherein a base line of the luminaire runs through the main emission side and a local height of the reflection side is measured against the base line, wherein a local focal length of the reflection side is increased along the local height when ray bundles come in parallel with the base line from an exterior of the luminaire during operation, wherein local heights do not have a common focal point, wherein the reflection side has a shape of a modified parabola when seen in the cross-section so that a distance of focal points of the ray bundles toward the reflection side along the base line increases with increasing local height, wherein the reflector comprises a metal foil, wherein the focal points are located on a bended curve when seen in the cross-section, the bended curve being a parabola or a spiral line, and wherein a curvature radius of the bended curve is increased in a direction away from the base line.

16. The luminaire according to claim 15, further comprising a housing in which the reflector and the light-emitting semiconductor chip are located, wherein the housing encloses the reflector and the light-emitting semiconductor chip in a waterproof and gas tight manner.

17. The luminaire according to claim 16, wherein the housing comprises a plurality of the light-emitting semiconductor chips arranged along a straight line, and wherein a length of the housing along the straight line exceeds a height as well as a width of the housing by at least a factor of 100.

18. The luminaire according to claim 15, further comprising a cover sheet, wherein the luminaire is configured to emit light through the cover sheet, wherein the cover sheet is oriented perpendicular to the base line and touches the reflector on a side remote from the at least one light-emitting semiconductor chip.

19. An illumination system comprising:

at least one luminaire comprising:

at least one light-emitting semiconductor chip having a main emission side;

a mounting plane; and a reflector having a reflection side facing the main emission side, the reflection side being a freeform different from a circle, an ellipse, a parabola or a hyperbola when seen in cross-section, wherein a base line of the luminaire runs through the main emission side and a local height of the reflection side is measured against the base line, wherein a local focal length of the reflection side is increased along the local height when ray bundles come in parallel with the base line from an exterior of the luminaire during operation, wherein local heights do not have a common focal point, wherein the luminaire is arranged on a wall or a pillar of a building which has at least in part a glass front, wherein the luminaire is arranged to illuminate a part of the building that protrudes from the wall or the pillar, wherein at most 2% of the light emitted by the luminaire enters the building so that glaring within the building is avoided, wherein the reflection side, when seen in the cross-section, has a shape of a modified parabola so that a distance of focal points of the ray bundles toward the reflection side along the base line increases with increasing local height, wherein the base line is in parallel with the mounting plane, wherein the luminaire is mounted on the building with the mounting plane so that the mounting plane is on a side of the luminaire facing the building, wherein an angle between the base line and a direction of maximum emission of the luminaire is at least 2° and at most 15°, the direction of the maximum emission points away from the mounting plane, and wherein the base line runs through the main emission side so that the base line and the main emission side have a point of intersection.

* * * * *